US011335235B2

(12) United States Patent
Guo

(10) Patent No.: US 11,335,235 B2
(45) Date of Patent: May 17, 2022

(54) DISPLAY DRIVING METHOD AND DISPLAY DRIVING DEVICE

(71) Applicants: HKC Corporation Limited, Guangdong (CN); Chongqing HKC Optoelectronics Technology Co., Ltd., Chongqing (CN)

(72) Inventor: Dongsheng Guo, Shenzhen (CN)

(73) Assignees: HKC CORPORATION LIMITED, Shenzhen (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 33 days.

(21) Appl. No.: 16/609,806

(22) PCT Filed: May 26, 2017

(86) PCT No.: PCT/CN2017/086166
§ 371 (c)(1),
(2) Date: Oct. 31, 2019

(87) PCT Pub. No.: WO2018/201539
PCT Pub. Date: Nov. 8, 2018

(65) Prior Publication Data

US 2020/0058246 A1 Feb. 20, 2020

(30) Foreign Application Priority Data

May 2, 2017 (CN) ..... 201710303054.9

(51) Int. Cl.
*G09G 3/20* (2006.01)

(52) U.S. Cl.
CPC ... *G09G 3/2074* (2013.01); *G09G 2310/0254* (2013.01); *G09G 2310/0275* (2013.01)

(58) Field of Classification Search
CPC ..... G09G 3/3614; G09G 3/20; G09G 3/2074; G09G 2310/0254; G09G 2310/0275;
(Continued)

(56) References Cited

U.S. PATENT DOCUMENTS

2001/0004253 A1* 6/2001 Fukutoku ..... G09G 3/3614 345/96
2010/0001942 A1* 1/2010 Lin ..... G09G 3/3614 345/100

(Continued)

FOREIGN PATENT DOCUMENTS

CN 101896961 A 11/2010
CN 101903938 A 12/2010

(Continued)

*Primary Examiner* — Aneeta Yodichkas
(74) *Attorney, Agent, or Firm* — Muncy, Geissler, Olds & Lowe, P.C.

(57) ABSTRACT

A display driving method and a display driving device are disclosed. The display driving method includes the steps of: setting an image signal to be inputted, so that when the image signal is driven on a display panel, a first sub-pixel showing a positive polarity is displayed, and other sub-pixels are not displayed; copying the set image signal by the logic board and inputting the set image signal to the display panel; and finally inputting a gate drive signal.

16 Claims, 8 Drawing Sheets

(58) Field of Classification Search
CPC ... G09G 2320/0247; G09G 2340/0407; G09G 2300/0426
See application file for complete search history.

(56) References Cited

U.S. PATENT DOCUMENTS

| | | | | |
|---|---|---|---|---|
| 2015/0170590 | A1* | 6/2015 | Ahn | G09G 3/3614 345/96 |
| 2015/0348489 | A1* | 12/2015 | Kabe | G09G 3/20 345/206 |
| 2016/0133176 | A1 | 5/2016 | Oh et al. | |

FOREIGN PATENT DOCUMENTS

| | | | |
|---|---|---|---|
| CN | 105243980 | A | 1/2016 |
| CN | 106531098 | A | 3/2017 |
| JP | 6002443 | B2 | 10/2016 |

* cited by examiner

DISPLAY DRIVING METHOD AND DISPLAY DRIVING DEVICE

BACKGROUND

Technical Field

This disclosure relates to a technical field of a display, and more particularly to a display driving method and a display driving device.

Related Art

At present, the ultra-high-definition display panel adopts a full-high-definition logic board to assemble the design of a printed circuit board to display the ultra-high-definition screen.

However, designing the ultra-high-definition glass panel through the full-high-definition logic board is equivalent to copying one input display pixel into 4 pixels. Taking the column inversion as an example, if the full-high-definition driving method is still used, then the resolution becomes ¼ that of the original resolution. In addition, when displaying on the ultra-high-definition display panel, red, green and blue pixels in the neighboring column directions have the opposite polarities. At this time, the frame display of one of the polarities cannot be independently turned off, and the flickering confirmation and the optimum adjustment cannot be performed.

SUMMARY

This disclosure provides a display driving method of a display panel executed by a computer apparatus capable of performing the flickering confirmation on the ultra-high-definition display panel when the ultra-high-definition display panel is driven by the full-high-definition logic board.

The disclosure provides a display driving method of a display panel executed by a computer apparatus. The method comprises steps of: setting an image signal by a processor, so that when the image signal is driven on the display panel, a first sub-pixel showing a positive polarity is displayed, and other sub-pixels are not displayed; copying the image signal through a logic board and then inputting the image signal to the display panel; and controlling an input of a gate drive signal to display an image.

In one embodiment, the step of setting the image signal by the processor, so that when the image signal is driven on the display panel, the first sub-pixel showing the positive polarity is displayed, and the other sub-pixels are not displayed comprises: setting the image signal, so that when the image signal is driven in a row inversion manner on the display panel, the first sub-pixel showing the positive polarity in an odd-numbered column of pixel point is displayed, and other sub-pixels are not displayed; or when the image signal is driven in a two-column inversion manner on the display panel, the first sub-pixel showing the positive polarity at cross pixel points of an odd-numbered column and an odd-numbered row and an even-numbered column and an even-numbered row is displayed, and other sub-pixels are not displayed.

In one embodiment, the step of copying the image signal through the logic board and then inputting the image signal to the display panel comprises: receiving the image signal and decoding the image signal into a first region image signal and a second region image signal; copying the first region image signal to obtain a third region image signal and a fourth region image signal, and copying the second region image signal to obtain a fifth region image signal and a sixth region image signal; and inputting the third region image signal and the fourth region image signal, and the fifth region image signal and the sixth region image signal to the display panel.

In one embodiment, the gate drive signal drives scan lines of the display panel in a paired manner.

In one embodiment, second, first and third sub-pixel columns of the display panel are respectively grouped according to combinations of a $(2n+1)^{th}$ column and a $(2n+2)^{th}$ column, where $0 \leq n \leq 5759$, and under a row-inversion and two-column inversion driving mode, the second, first, and third sub-pixels in the same group have the same polarity, and the second, first and third sub-pixels between neighboring groups have opposite polarities.

In one embodiment, a driving polarity of the sub-pixel of the display panel is controlled by an inputted data signal.

The disclosure also provides a display driving device of a display panel. The display driving device comprises a processor and a nonvolatile memory. The nonvolatile memory stores executable instructions, the processor performs the executable instructions, and the executable instructions comprise: an image signal setting module setting an image signal, so that when the image signal is driven on the display panel, a first sub-pixel showing a positive polarity is displayed, and other sub-pixels are not displayed; an image signal input module copying the image signal through a logic board and then inputting the image signal to the display panel; and a display module controlling an input of a gate drive signal to display an image.

In one embodiment, the image signal setting module is configured to set the image signal, so that when the image signal is driven in a row inversion manner on the display panel, the first sub-pixel showing a positive polarity in an odd-numbered column of pixel point is displayed, and other sub-pixels are not displayed; or when the image signal is driven in a two-column inversion manner on the display panel, the first sub-pixel showing a positive polarity at cross pixel points of an odd-numbered column and an odd-numbered row and an even-numbered column and an even-numbered row is displayed, and other sub-pixels are not displayed.

In one embodiment, the image signal input module comprises a decoding unit. The decoding unit receives the image signal and decodes the image signal into a first region image signal and a second region image signal. The timing processing unit copies the first region image signal to obtain a third region image signal and a fourth region image signal, and copies the second region image signal to obtain a fifth region image signal and a sixth region image signal. The signal input unit inputs the third region image signal, the fourth region image signal, the fifth region image signal and the sixth region image signal to the display panel.

In one embodiment, the gate drive signal drives scan lines of the display panel in a paired manner.

In the display driving method of the display panel of this disclosure, the image signal to be inputted is set, so that when the image signal is driven on the display panel, the first sub-pixel showing the positive polarity is displayed, and other sub-pixels are not displayed, and then the set image signal is copied by the logic board, and inputted to the display panel. Finally, by inputting the gate drive signal, the bright-dark interlacing image display can be seen (i.e., the flickering confirmation is implemented), so that optimum debugging can be performed on the voltage of the display electrode of the ultra-high-definition display panel.

BRIEF DESCRIPTION OF THE DRAWINGS

The embodiments will become more fully understood from the detailed description and accompanying drawings, which are given for illustration only, and thus are not limitative of the present invention, and wherein.

The implementation, functional characteristics and advantages of the present disclosure will be further described with reference to the accompanying drawings.

DETAILED DESCRIPTION OF THE INVENTION

The embodiments of the invention will be apparent from the following detailed description, which proceeds with reference to the accompanying drawings, wherein the same references relate to the same elements.

The display driving method and device of a display panel proposed by this disclosure can be applied to the ultra-high-definition display panel, which may be driven using the logic board of the full-high-definition display panel, wherein the display panel may be, for example, a LCD display panel, an OLED display panel, a QLED display panel, a curved surface display panel or any other display panel.

Figure 1:
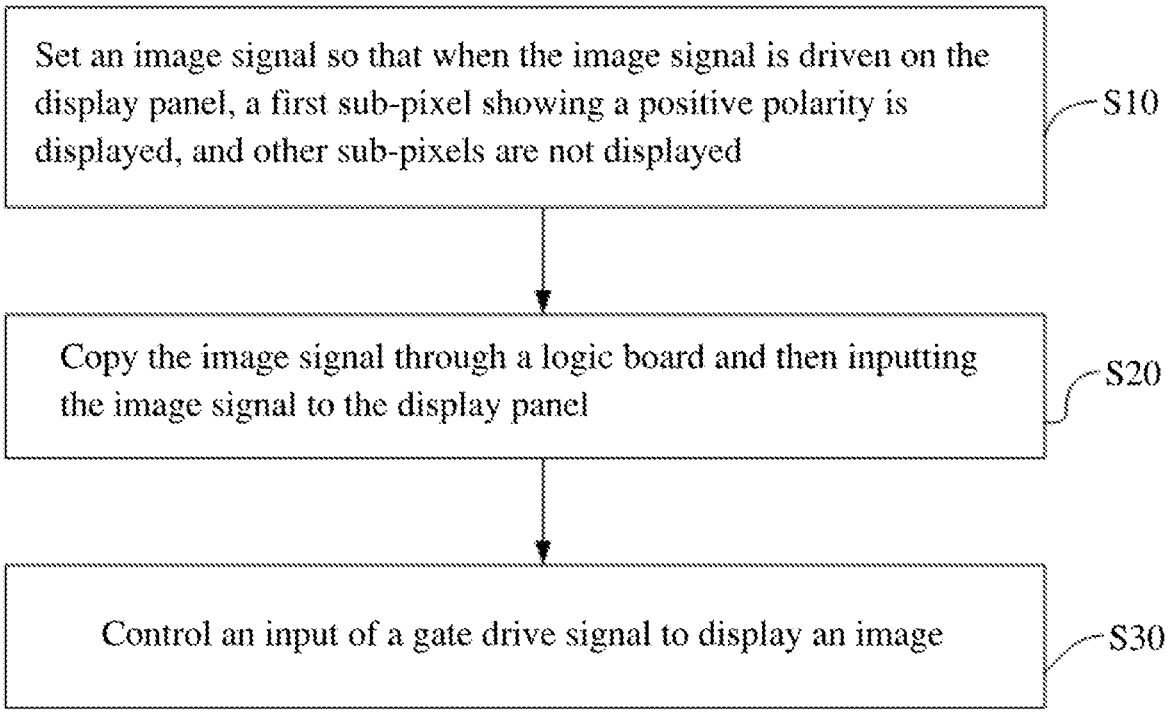
FIG. 1 is s flow chart showing a display driving method of a display panel according to an embodiment of this disclosure.

FIG. 1 is s flow chart showing a display driving method of a display panel according to an embodiment of this disclosure.

As shown in FIG. 1, in this disclosure, the display driving method of a display panel comprises the following steps:

Step S10: setting an image signal by a processor, so that when the image signal is driven on the display panel, a first sub-pixel showing a positive polarity is displayed, and other sub-pixels are not displayed;

In more specific, the step S10 is to set the image signal, so that when the image signal is driven in a row inversion manner on the display panel, the first sub-pixel showing the positive polarity in an odd-numbered column of pixel point is displayed, and other sub-pixels are not displayed; or when the image signal is driven in a two-column inversion manner on the display panel, the first sub-pixel showing the positive polarity at cross pixel points of an odd-numbered column and an odd-numbered row and an even-numbered column and an even-numbered row is displayed, and other sub-pixels are not displayed.

Step S20: copying the image signal through a logic board and then inputting the image signal to the display panel; and Step S30; controlling an input of a gate drive signal to display an image.

Figure 2:
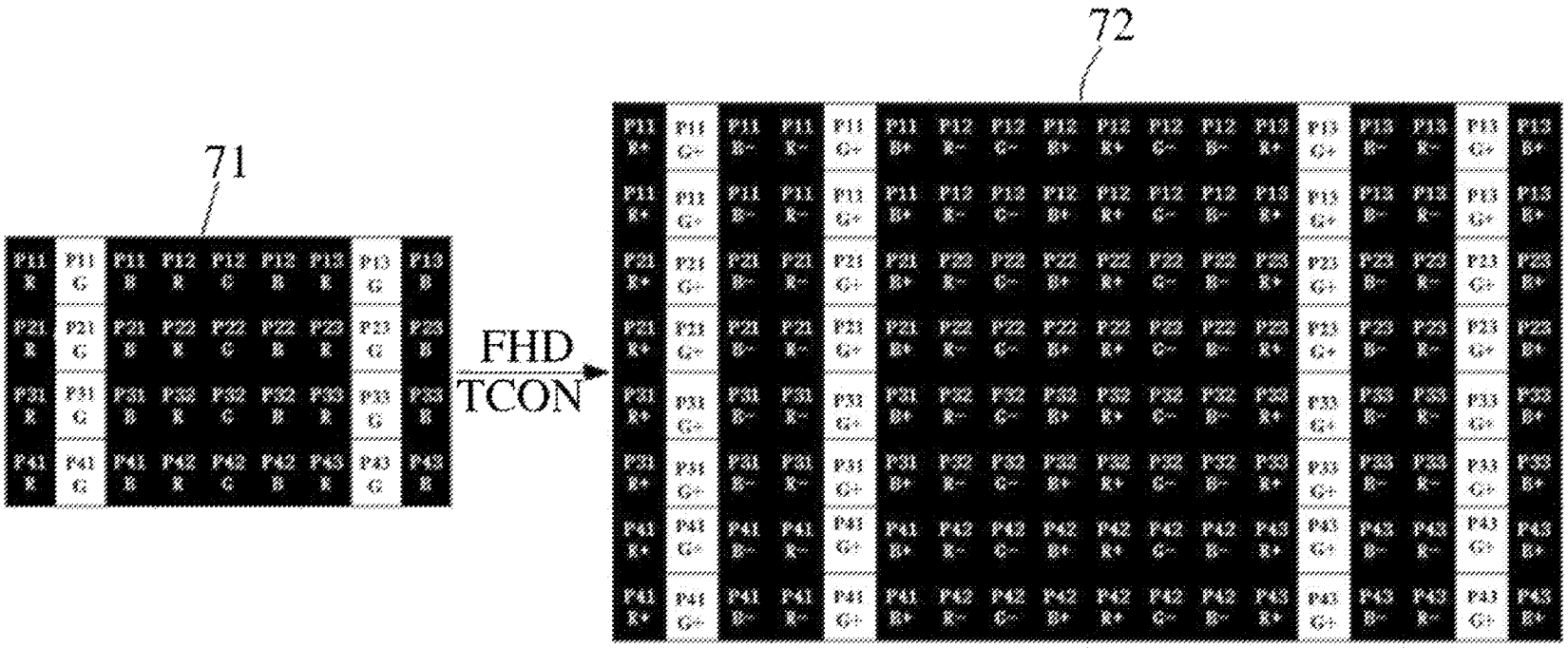
FIG. 2 is a schematic view showing an image signal displayed on full-high-definition and ultra-high-definition display panels upon row inversion driving.

In this embodiment, the display driving method of a display panel is carried out based on the full-high-definition TCON (Timer Control Register, logic board). The display frame on the full-high-definition display panel is copied and then displayed on the ultra-high-definition display panel. The implementation of the flash needs the sub-pixels, which have the same polarity, and must be the sub-pixels having the positive polarities. However, under normal circumstances, one RGB pixel point of the full-high-definition input, such as P11R, P11G, P11B, can display two groups of P11R+, P11G−, P11B+/P11R−, P11G+, P11B− upon displaying the input to the ultra-high-definition display panel through the TCON. At this time, the frame display of one of the polarities cannot be turned off, so one RGB pixel point of the full-high-definition input needs to display two groups of P11R+, P11G+, P11B−/P11R−, P11G+, P11B+ upon displaying the input to the ultra-high-definition display panel through the TCON. That is, the image signal is set, so that the green sub-pixel showing the positive polarity in the odd-numbered column of pixel point is displayed, and other sub-pixels are not displayed when it is driven in a row inversion manner on the full-high-definition display panel. As the reference number 71 of FIG. 2, at this time, the image signal is inputted to the ultra-high-definition display panel by the full-high-definition logic board, the input of the gate drive signal is controlled, and when the image is displayed, the display frame as the reference number 72 shown in FIG. 2 is displayed. That is, when the driving display is performed on the ultra-high-definition display panel, a brightness difference is present between the green sub-pixel, which has the positive polarity and is displayed in the odd column, and the green sub-pixel, which has the negative polarity and is not displayed on the next frame, and the flicker can be seen on the display frame when the gate drive signal drives the ultra-high definition display panel to display the frame.

Figure 3:
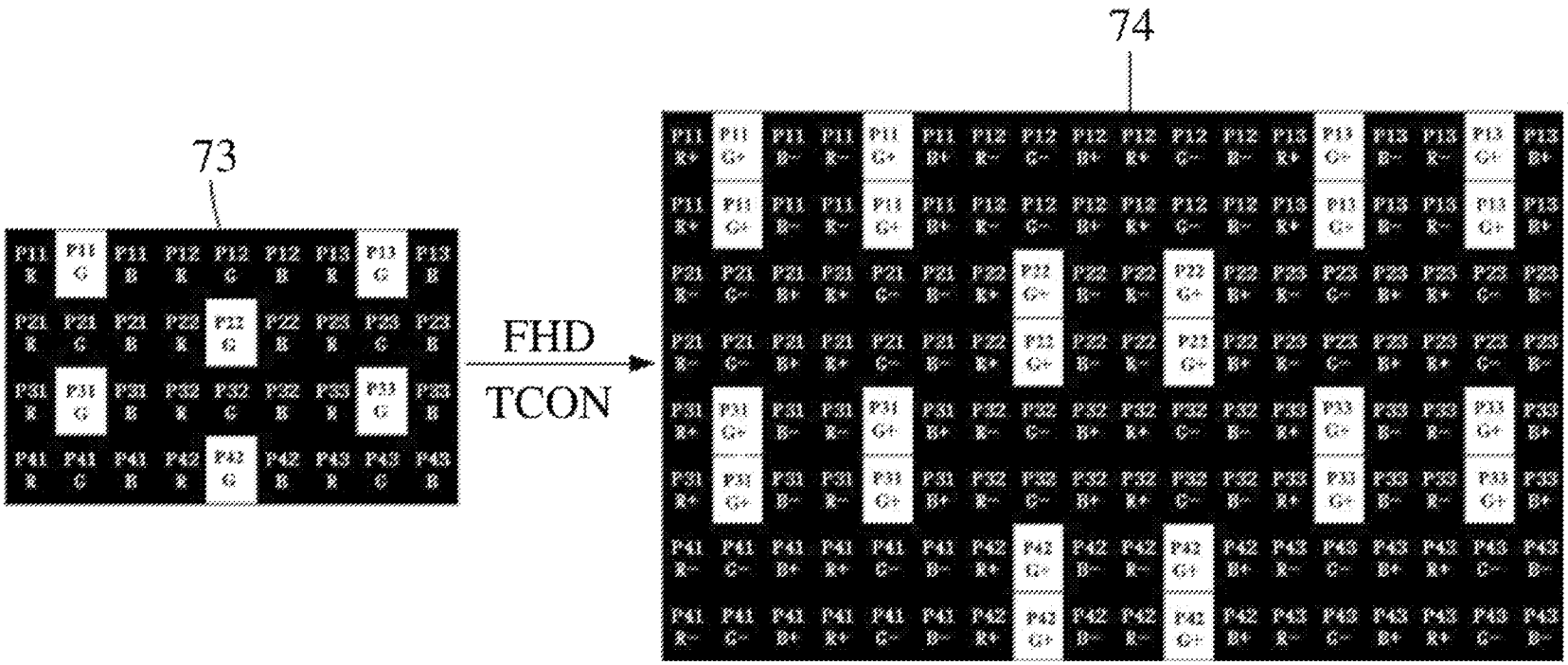
FIG. 3 is a schematic view showing an image signal displayed on the full-high-definition and ultra-high-definition display panels upon two-column inversion driving.

In one embodiment, when the image signal is driven in a two-column inversion manner on the full-high-definition display panel, the green sub-pixels showing the positive polarity at the cross pixel points of the odd-numbered column and odd-numbered row and the even-numbered column and even-numbered row are set to display, and other sub-pixels are not displayed. As the reference number 73 of FIG. 3, at this time, the image signal is inputted to the ultra-high-definition display panel by the full-high-definition logic board, and the gate drive signal is inputted, and when the image is displayed, the display frame as the reference number 74 shown in FIG. 3 is displayed. That is, when the image is displayed on the ultra-high-definition display panel, that is, when the driving is displayed on the ultra-high-definition display panel, a brightness difference is present between the green sub-pixel, which has the positive polarity and displays at cross pixel points of the odd-numbered column and the odd-numbered row and the even-numbered column and the even-numbered row, and the green sub-pixel, which has the negative polarity and is not displayed on the next frame, and the flicker can be seen on the display frame when the gate drive signal drives the ultra-high definition display panel to display the frame.

In the display driving method of this disclosure, the image signal to be inputted is set, so that when the image signal is driven on the full HD display panel, the green sub-pixel showing the positive polarity is displayed, and other sub-pixels are not displayed. Then, the set image signal is inputted to the ultra-high-definition panel by the full-high-definition logic board and finally the gate drive signal is inputted. The bright-dark interlacing image display can be seen (i.e., the flickering confirmation is implemented), so that optimum debugging can be performed on the voltage of the display electrode of the ultra-high-definition display panel.

Figure 4:
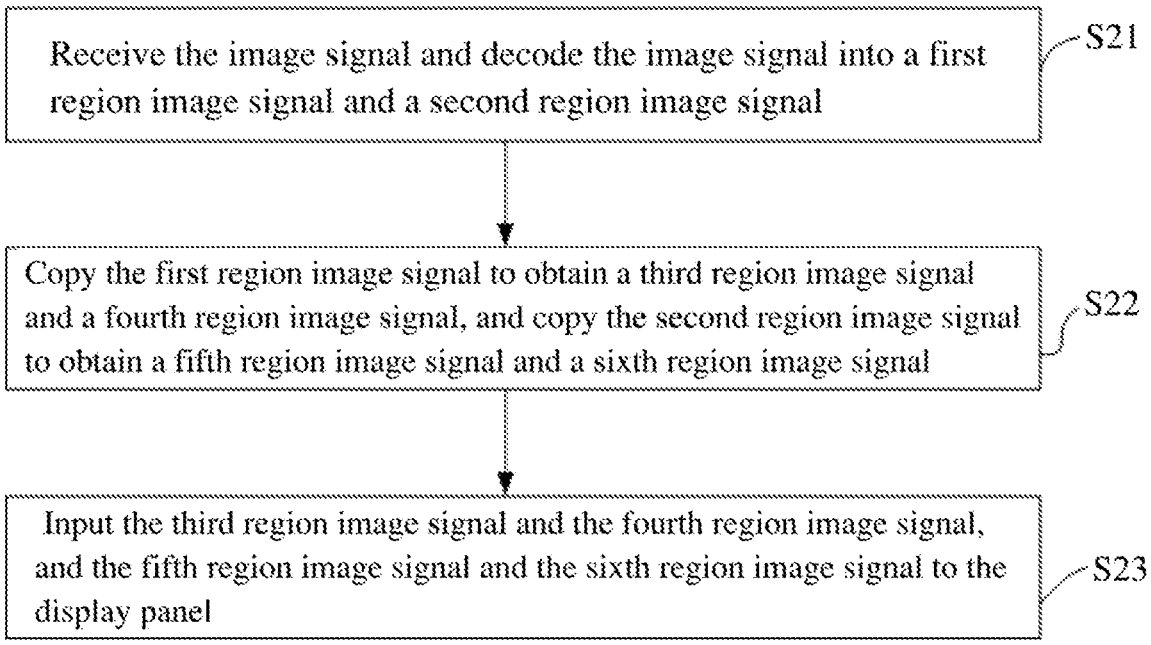
FIG. 4 is a specific flow chart showing a step S20 in FIG. 1.

In one embodiment, as shown in FIG. 4, the step S20 of the display driving method comprises:

Step 21: receiving the image signal and decoding the image signal into a first region image signal and a second region image signal;

Step 22: copying the first region image signal to obtain a third region image signal and a fourth region image signal, and copying the second region image signal to obtain a fifth region image signal and a sixth region image signal; and Step 23: inputting the third region image signal and the fourth region image signal, and the fifth region image signal and the sixth region image signal to the display panel.

In this embodiment, after an image signal to be inputted to the ultra-high-definition display panel is set on the full-high-definition display panel, a full-high-definition timer control register (TCON, logic board) finally divides the image signal into four signals, which are respectively a third region image signal, a fourth region image signal, a fifth region image signal and a sixth region image signal. Each region image signal is in charge of one-fourth of the frame display to match with the ultra-high-definition display panel.

Referring to FIGS. 2 and 3, the inputted image signal is displayed on the full-high-definition display panel as the pixels 11, 12, 13, 21, 22, 23, 31, 32, 33, 41, 42 and 43. After being decoded and copied by the full-high-definition TCON, one single pixel is copied into four, and neighboring pixel points display the same resolution of display effects on the ultra-high-definition display panel, thereby implementing the utilization of the full-high-definition image signal to drive the ultra-high-definition display panel to display, and saving the cost.

Figure 5:
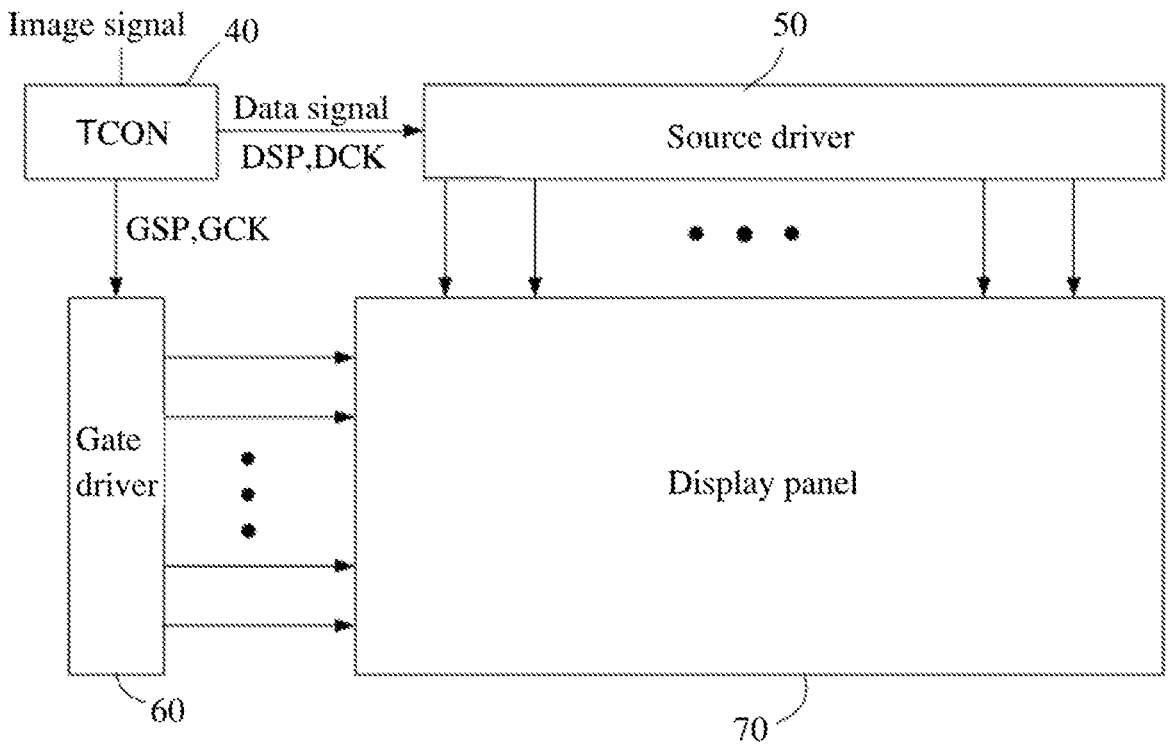
FIG. 5 is a functional module diagram of driving a display panel.

Referring to FIG. 5, the driving of a display panel 70 is usually accomplished by a source driver 50 and a gate driver 60 cooperating with each other. The set full-high-definition image signal is inputted to a timer control register (TCON, logic board) 40, and transformed into a data signal for controlling driving polarities of sub-pixels of the ultra-high-definition display panel, a clock control signal DSP/DCK of the source driver 50 and a clock control signal GSP/GCK of the gate driver 60. Specifically, the source driver 50 loads the data signal to control the driving polarities of the RGB sub-pixels, and the gate driver 60 controls the timings to drive scan lines of the ultra-high-definition display panel in a paired manner, so that a flickering display for displaying one bright frame and one dark frame on the ultra-high-definition display panel can be achieved.

Figure 6:
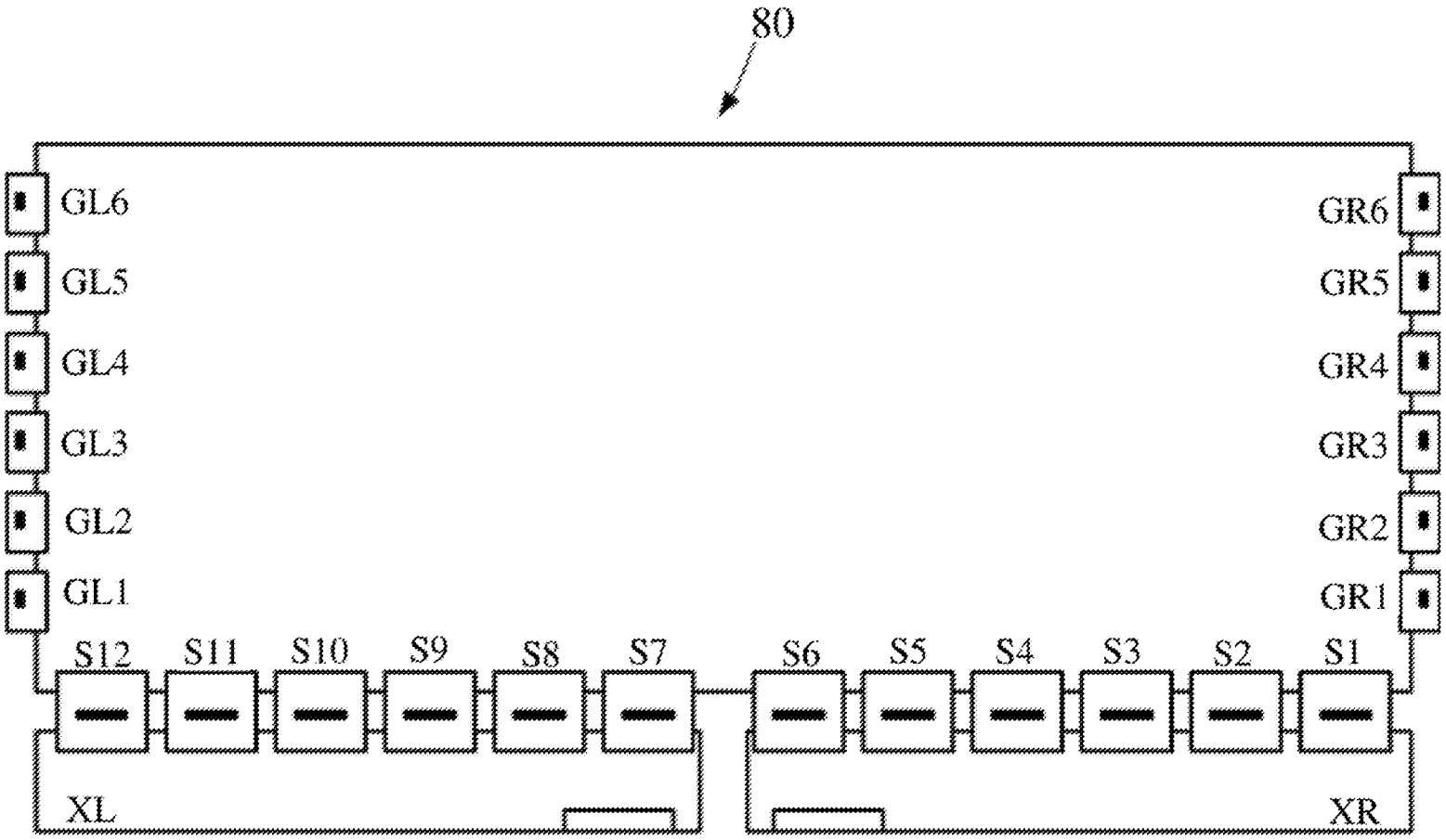
FIG. 6 is a schematic structure view showing a display driving device of the display panel according to this disclosure.
Figure 7:
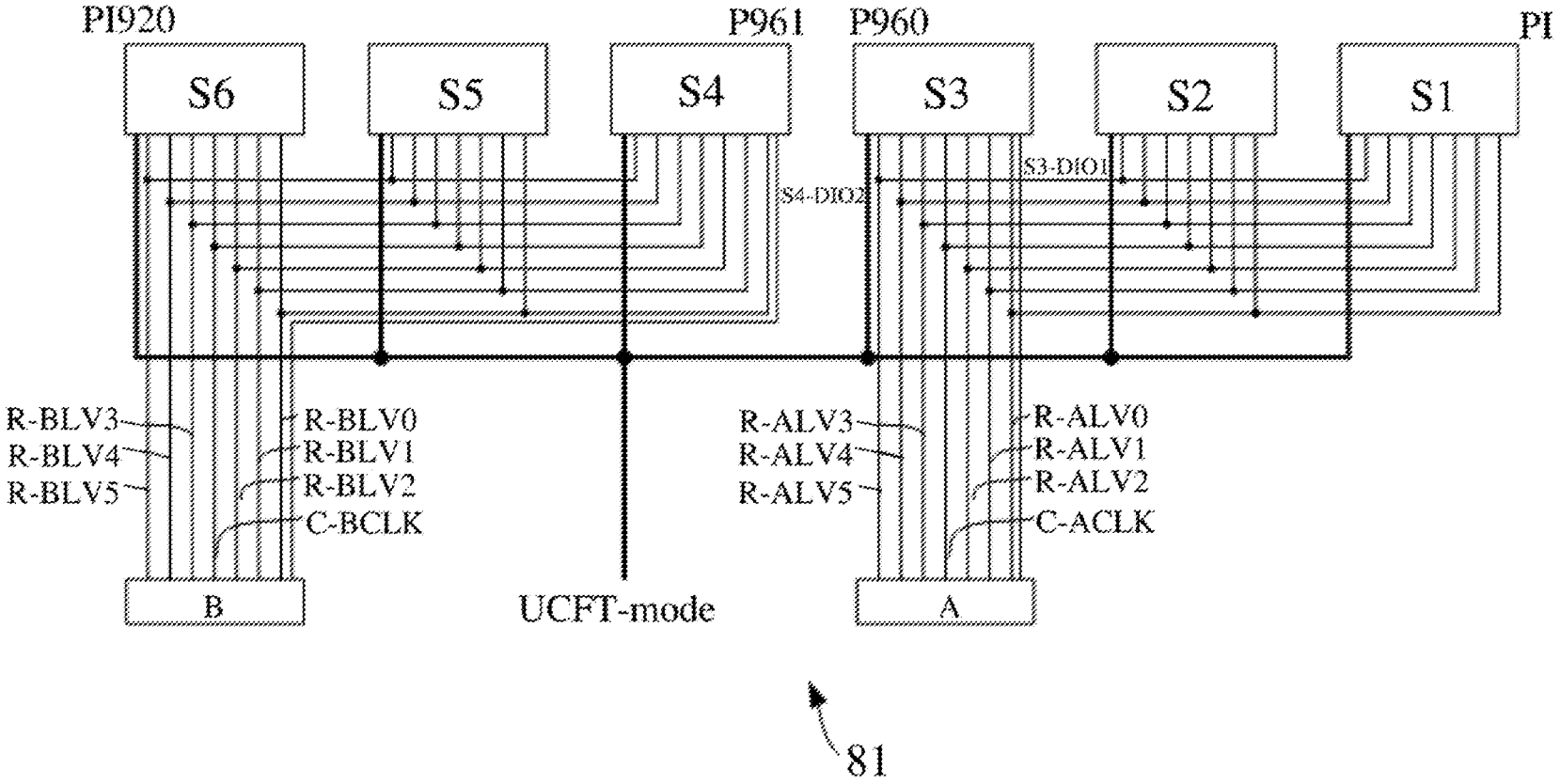
FIG. 7 is a schematic view showing partial line connections on a right side of FIG. 6.

Referring to a display driving device 80 of the display panel in FIG. 6 and lines 81 on the right side portion of the display driving device 80 of the display panel in FIG. 7 in the embodiment of this disclosure, the driving architecture program of 1D1G of the ultra-high-definition (UD) (where D represents the data line, G represents the scan line, and each of the number of the data line and the number of the scan line independently inputted is 1) is adopted. The driving architecture includes 12 source drivers and 12 gate drivers. The 12 source drivers and the 12 gate drivers are disposed symmetrically.

In the actual configuration, the 12 source drivers are divided into left and right sets, and each set includes 6 source drivers. Each set of 3 source drivers share one data interface. Thus, the 12 source drivers include four data interfaces in total to respectively receive four image signals inputted from the full-high-definition TCON.

Because the left and right source driving structures are completely the same, the right set will be described herein.

The right set includes source drivers S1, S2, S3, S4, S5 and S6 arranged from right to left in order. Each source driver includes one clock line, six data lines and one data transmission trigger line. The source drivers S1, S2 and S3 share one data interface, and the source drivers S4, S5 and S6 share one data interface.

Respective six data lines of the source drivers S1, S2 and S3 are short circuited one by one, the clock lines are short circuited one by one, the data transmission trigger lines are short circuited one by one, and the source drivers S1, S2 and S3 are short circuited and then drawn from the interface A and connected to the TCON board. Similarly, the source drivers S4, S5 and S6 are short circuited and then drawn from the interface B. A lead line of the interface A includes one clock line R-ACLK and six data lines, which are respectively R-ALV0 to R-ALV5, and a lead line of the interface B includes one clock line R-BCLK and six data lines, which are respectively R-BLV0 to R-BLV5. Each of the interfaces A and B further includes data transmission trigger lines S3-DIO1 and S4-DIO2. In addition, the right set further includes a mode switching line UCFT-mode (unsteady cooperative flow type mode). The switching line is connected to the source drivers S1, S2, S3, S4, S5 and S6 in order to switch between two display driving modes, that is, between the ultra-high-definition mode and the full-high-definition mode.

It can be easily understood that the left set includes an interface C and an interface D. A lead line of the interface C includes one clock line R-CCLK and six data lines, which are respectively R-CLV0 to R-CLV5 and the lead line of the interface D includes one clock line R-DCLK and six data lines, which are respectively R-DLV0 to R-DLV5. Each of the interfaces C and D further includes data transmission trigger lines S9-DIO3 and S10-DIO4. In addition, the left set further includes a mode switching line UCFT-mode, wherein the switching line is connected to the source drivers S7, S8, S9, S10, S11 and S12 in order to switch between two display driving modes, that is, between the ultra-high-definition mode and the full-high-definition mode.

Each source driver drives 320 columns of pixels, and 12 source drivers drive 3840 columns of pixels in total.

This embodiment further includes 12 gate drivers, which are respectively GR1 to GR6 and GL1 to GL6, wherein GR1 to GR6 are disposed on the right side of the display panel, and GL1 to GL6 are disposed on the left side of the display panel. Each gate driver drives 360 rows of pixels. In this embodiment, there are 2160 rows of pixels in total, P1 to P2160. Specifically, the gate drive signal drives the scan lines of the display panel in a paired manner, that is, firstly drives P1/P2, and then P3/P4, P5/P6 . . . until P2159/P2160.

In this embodiment, the third region image signal and the fourth region image signal are differential signals. That is, the inputs of the interfaces A, B, C and D are mini-low voltage differential signals (mini-LVDS).

Specifically, the signal lines of the third region image signal are connected to the signal lines of the fourth region image signal one by one, to then receive the inputted first region image signal, and the signal lines of the fifth region image signal are connected to the signal lines of the sixth region image signal one by one to then receive the inputted second region image signal. In this embodiment, the signal is copied by short circuiting the input lines corresponding to each source driver.

Specifically, each of the third region image signal, the fourth region image signal, the fifth region image signal and the sixth region image signal includes two RGB pixel signals.

It is to be described that, for example, R-ALV0 to R-ALV2 input one RGB pixel signal, and R-ALV3 to R-ALV5 input one RGB pixel signal.

In one embodiment, the second, first and third sub-pixel columns of the display panel are respectively grouped according to the combinations of the $(2n+1)^{th}$ column and the $(2n+2)^{th}$ column, where $0 \leq n \leq 5759$. In the row inversion and two-column inversion driving mode, the second, first, and third sub-pixels in the same group have the same polarity, while the second, first, third sub-pixels between neighboring groups have the opposite polarities.

As shown in FIGS. 2 and 3, the resolution of the ultra-high-definition display panel is 3840×2160, that is, the ultra-high-definition display panel has 3840×2160 pixel points in total, and each pixel point includes 3 RGB sub-pixels. Thus is, the 1&2, 3&4, 5&6, . . . , (2n+1)&(2n+2) columns are respectively grouped. The column is defined as being arranged into the group by the same sub-pixel. The row is defined as being arranged into the group by different sub-pixels. In some embodiments, the row and column form a certain angle on the same plane. Optionally, the row is perpendicular to the column. In this case, the red, green and blue sub-pixel column in the same group have the same polarity, and the red, green and blue sub-pixels between neighboring groups have the opposite polarities. As shown in FIG. 2, the sub-pixels R and G of P11 to P41 in the first group show the positive polarity, the sub-pixels B and R of P11 to P41 in the second group show the negative polarity, the green sub-pixel and B of P11 to P41 in the third group show the positive polarity, and the sub-pixels R and G of P12 to P42 in the fourth group show the negative polarity.

According to the display driving method of the above-mentioned display panel, this disclosure further provides a display driving device of the display panel.

Figure 8:
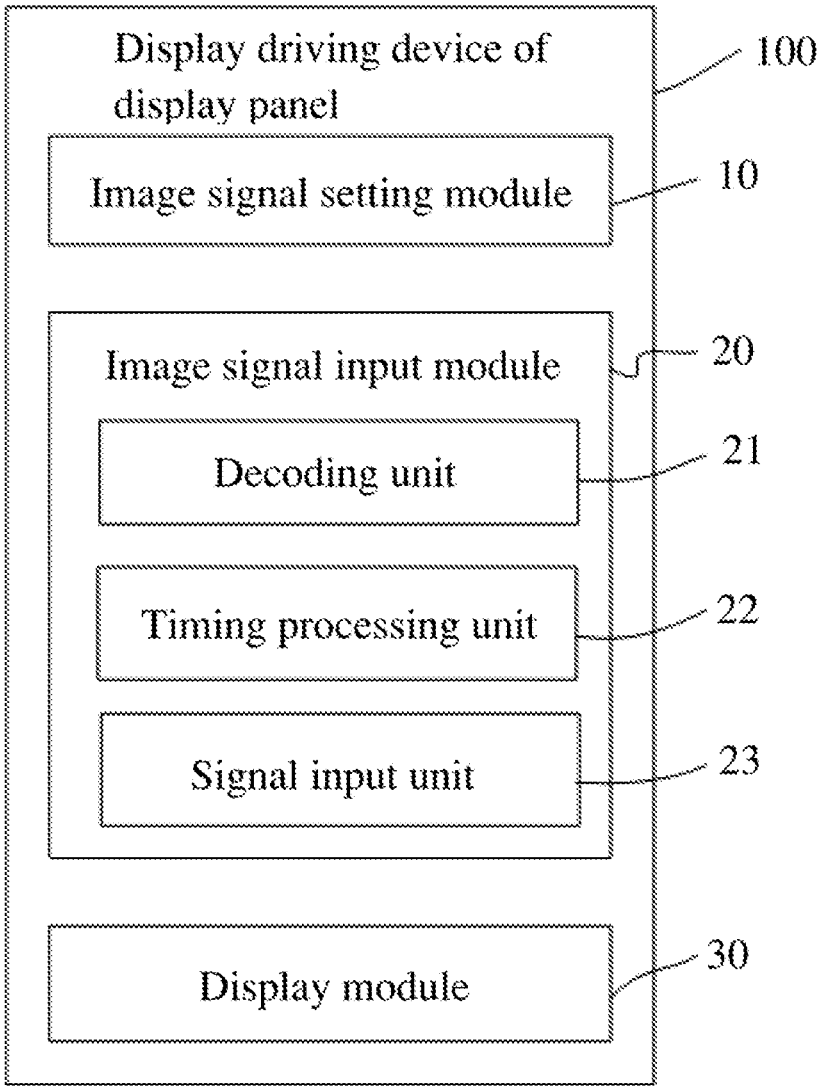
FIG. 8 is a functional module diagram showing a display driving device of the display panel according to an embodiment of this disclosure.

FIG. 8 is a functional module diagram showing a display driving device of the display panel according to an embodiment of this disclosure.

Referring to FIG. 8, in this embodiment, the display driving device 100 of a display panel comprises:

An image signal setting module 10 setting an image signal, so that when the image signal is driven on the display panel, a first sub-pixel showing a positive polarity is displayed, and other sub-pixels are not displayed;

An image signal input module 20 copying the image signal through a logic board and then inputting the image signal to the display panel; and A display module 30 controlling an input of a gate drive signal to display an image.

In one embodiment, the image signal setting module 10 is configured to set the image signal, so that when the image signal is driven in a row inversion manner on the display panel, the first sub-pixel showing a positive polarity in an odd-numbered column of pixel point is displayed, and other sub-pixels are not displayed; or when the image signal is driven in a two-column inversion manner on the display panel, the first sub-pixel showing a positive polarity at cross pixel points of an odd-numbered column and an odd-numbered row and an even-numbered column and an even-numbered row is displayed, and other sub-pixels are not displayed.

In this embodiment, a display driving device 100 of the display panel copies the display frame on the full-high-definition display panel and then displays the frame on the ultra-high-definition display panel based on the full-high-definition TCON. The implementation of the flash needs the sub-pixels, which have the same polarity, and must be the sub-pixels having the positive polarities. However, under normal circumstances, one RGB pixel point of the full-high-definition input, such as MR, P11G P11B, can display two groups of P11R+, P11G−, P11B+/P11R−, P11G+, P11B− upon displaying the input to the ultra-high-definition display panel through the TCON. At this time, the frame display of one of the polarities cannot be turned off, so one RGB pixel point of the full-high-definition input needs to display two groups of P11R+, P11G+, P11B−/P11R−, P11G+, P11B+ upon displaying the input to the ultra-high-definition display panel through the TCON. That is, an image signal setting module 10 sets the image signal, so that the green sub-pixel showing the positive polarity in the odd-numbered column of pixel point is displayed, and other sub-pixels are not displayed when it is driven in a row inversion manner on the full-high-definition display panel. At this time, an image signal input module 20 inputs the image signal to the ultra-high-definition display panel by the full-high-definition logic board, a display module 30 controls the input of the gate drive signal, and when the image is displayed, the display frame as shown in FIG. 2 is displayed. That is, when the driving display is performed on the ultra-high-definition display panel, a brightness difference is present between the green sub-pixel, which has the positive polarity and is displayed in the odd column, and the green sub-pixel, which has the negative polarity and is not displayed on the next frame, and the flicker can be seen on the display frame when the gate drive signal drives the ultra-high definition display panel to display the frame.

In one embodiment, when the image signal is driven in a two-column inversion manner on the full-high-definition display panel, the image signal setting module 10 sets to display the green sub-pixels showing the positive polarity at the cross pixel points of the odd-numbered column and the odd-numbered row and the even-numbered column and the even-numbered row, and not to display other sub-pixels. At this time, the image signal input module 20 inputs the image signal to the ultra-high-definition display panel by the full-high-definition logic board, the display module 30 controls the input of the gate drive signal, and when the image is displayed, the display frame as shown in FIG. 3 is displayed. That is, when the image is displayed on the ultra-high-definition display panel, that is, when the driving is displayed on the ultra-high-definition display panel, a brightness difference is present between the green sub-pixel, which has the positive polarity and displays at cross pixel points of the odd-numbered column and the odd-numbered row and the even-numbered column and the even-numbered row, and the green sub-pixel, which has the negative polarity and is not displayed on the next frame, and the flicker can be seen on the display frame when the gate drive signal drives the ultra-high definition display panel to display the frame.

In this disclosure, the display driving device 100 of the display panel sets the image signal to be inputted by the image signal setting module 10, so that when the image signal is driven on the full HD display panel, the green sub-pixel showing the positive polarity is displayed, and other sub-pixels are not displayed. Then, the image signal input module 20 inputs the set image signal to the ultra-high-definition panel by the full-high-definition logic board and finally controls the input of the gate drive signal by the display module 30. The bright-dark interlacing image display can be seen (i.e., the flickering confirmation is implemented), so that optimum debugging can be performed on the voltage of the display electrode of the ultra-high-definition display panel.

In one embodiment, as shown in FIG. 8, the image signal input module 20 comprises: a decoding unit 21 receiving the image signal and decoding the image signal into a first region image signal and a second region image signal; a timing processing unit 22 copying the first region image signal to obtain a third region image signal and a fourth region image signal, and copying the second region image signal to obtain a fifth region image signal and a sixth region image signal; and a signal input unit 23 inputting the third region image signal, the fourth region image signal, the fifth region image signal and the sixth region image signal to the display panel.

In this embodiment, after an image signal to be inputted to the ultra-high-definition display panel is set on the full-high-definition display panel, a full-high-definition timer control register (TCON, logic board) finally divides the image signal into four signals, which are respectively a third region image signal, a fourth region image signal, a fifth region image signal and a sixth region image signal. Each region image signal is in charge of one-fourth of the frame display to match with the ultra-high-definition display panel.

Referring to FIGS. 2 and 3, the inputted image signal is displayed on the full-high-definition display panel as the pixels 11, 12, 13, 21, 22, 23, 31, 32, 33, 41, 42 and 43. After being decoded and copied by the full-high-definition TCON, one single pixel is copied into four, and neighboring pixel points display the same resolution of display effects on the ultra-high-definition display panel, thereby implementing the utilization of the full-high-definition image signal to drive the ultra-high-definition display panel to display, and saving the cost.

Referring to FIG. 5, the driving of a display panel is usually accomplished by a source driver and a gate driver cooperating with each other. The set full-high-definition image signal is inputted to a timer control register (TCON, logic board), and transformed into a data signal for controlling driving polarities of sub-pixels of the ultra-high-definition display panel, a clock control signal DSP/DCK of the source driver and a clock control signal GSP/GCK of the gate driver. Specifically, the source driver loads the data signal to control the driving polarities of the RGB sub-pixels, and the gate driver controls the timings to drive scan lines of the ultra-high-definition display panel in a paired manner, so that a flickering display for displaying one bright frame and one dark frame on the ultra-high-definition display panel can be achieved.

In one embodiment, the second, first and third sub-pixel columns of the display panel are respectively grouped according to the combinations of the $(2n+1)^{th}$ column and the $(2n+2)^{th}$ column, where $0 \leq n \leq 5759$. In the row inversion and two-column inversion driving mode, the second, first, and third sub-pixels in the same group have the same polarity, while the second, first, third sub-pixels between neighboring groups have the opposite polarities.

As shown in FIGS. 2 and 3, the resolution of the ultra-high-definition display panel is 3840×2160, that is, the ultra-high-definition display panel has 3840×2160 pixel points in total, and each pixel point includes 3 RGB sub-pixels. Thus is, the 1&2, 3&4, 5&6, . . . , (2n+1)&(2n+2) columns are respectively grouped. The column is defined as being arranged into the group by the same sub-pixel. The row is defined as being arranged into the group by different sub-pixels. In some embodiments, the row and column form a certain angle on the same plane. Optionally, the row is perpendicular to the column. In this case, the red, green and blue sub-pixel column in the same group have the same polarity, and the red, green and blue sub-pixels between neighboring groups have the opposite polarities. As shown in FIG. 2, the sub-pixels R and G of P11 to P41 in the first group show the positive polarity, the sub-pixels B and R of P11 to P41 in the second group show the negative polarity, the green sub-pixel and B of P11 to P41 in the third group show the positive polarity, and the sub-pixels R and G of P12 to P42 in the fourth group show the negative polarity.

It will be understood by those skilled in the art that this disclosure further provides a display driving device of the display panel. The device includes a processor and a non-volatile memory. The nonvolatile memory stores executable instructions. The processor performs the executable instructions to implement the methods described in the embodiments described above. It will be further understood by those skilled in the art that the modules/units 10, 20, 21, 22, 23 and 30 as shown in FIG. 8 in this disclosure may be software modules or software units. In addition, various software modules or software units may be inherently stored in the non-volatile memory and executed by the processor.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A display driving method of a display panel executed by a computer apparatus, the method comprising steps of:

setting an image signal by a processor, so that when the image signal is driven in a two-column inversion manner on the display panel, only green sub-pixels with positive polarity at cross pixel points of an odd-numbered column and an odd-numbered row and an even-numbered column and an even-numbered row are displayed, and other sub-pixels are not displayed;

copying the image signal through a logic board and then inputting the image signal to the display panel; and controlling an input of a gate drive signal to display an image.

2. The method according to claim 1, wherein the step of copying the image signal through the logic board and then inputting the image signal to the display panel comprises:

receiving the image signal and decoding the image signal into a first region image signal and a second region image signal;

copying the first region image signal to obtain a third region image signal and a fourth region image signal, and copying the second region image signal to obtain a fifth region image signal and a sixth region image signal; and inputting the third region image signal and the fourth region image signal, and the fifth region image signal and the sixth region image signal to the display panel.

3. The method according to claim 2, wherein a driving polarity of the sub-pixel of the display panel is controlled by an inputted data signal.

4. The method according to claim 1, wherein the gate drive signal drives scan lines of the display panel in a paired manner.

5. The method according to claim 4, wherein a driving polarity of the sub-pixel of the display panel is controlled by an inputted data signal.

6. The method according to claim 1, wherein second, first and third sub-pixel columns of the display panel are respectively grouped according to combinations of a $(2n+1)^{th}$ column and a $(2n+2)^{th}$ column, where $0 \leq n \leq 5759$, and under a row-inversion and two-column inversion driving mode, the second, first, and third sub-pixels in the same group have the same polarity, and the second, first and third sub-pixels between neighboring groups have opposite polarities.

7. The method according to claim 6, wherein a driving polarity of the sub-pixel of the display panel is controlled by an inputted data signal.

8. The method according to claim 1, wherein a driving polarity of the sub-pixel of the display panel is controlled by an inputted data signal.

9. A display driving device of a display panel, wherein the device comprises a processor and a memory, the memory stores executable instructions, the processor performs the executable instructions, and the executable instructions comprise:

an image signal setting module setting an image signal, so that when the image signal is driven in a two-column inversion manner on the display panel, only green sub-pixels with the positive polarity at cross pixel points of an odd-numbered column and an odd-numbered row and an even-numbered column and an even-numbered row are displayed, and other sub-pixels are not displayed;

an image signal input module copying the image signal through a logic board and then inputting the image signal to the display panel; and a display module controlling an input of a gate drive signal to display an image.

10. The device according to claim 9, wherein the image signal input module comprises:

a decoding unit receiving the image signal and decoding the image signal into a first region image signal and a second region image signal;

a timing processing unit copying the first region image signal to obtain a third region image signal and a fourth region image signal, and copying the second region image signal to obtain a fifth region image signal and a sixth region image signal; and a signal input unit inputting the third region image signal, the fourth region image signal, the fifth region image signal and the sixth region image signal to the display panel.

11. The device according to claim 10, wherein a driving polarity of the sub-pixel of the display panel is controlled by an inputted data signal.

12. The device according to claim 9, wherein the gate drive signal drives scan lines of the display panel in a paired manner.

13. The device according to claim 12, wherein a driving polarity of the sub-pixel of the display panel is controlled by an inputted data signal.

14. The device according to claim 9, wherein second, first and third sub-pixel columns of the display panel are respectively grouped according to combinations of a $(2n+1)^{th}$ column and a $(2n+2)^{th}$ column, $0 \leq n \leq 5759$, and under a row-inversion and two-column inversion driving mode, the second, first, and third sub-pixels in the same group have the same polarity, and the second, first, third sub-pixels between neighboring groups have opposite polarities.

15. The device according to claim 14, wherein a driving polarity of the sub-pixel of the display panel is controlled by an inputted data signal.

16. The device according to claim 9, wherein a driving polarity of the sub-pixel of the display panel is controlled by an inputted data signal.

* * * * *